United States Patent [19]

Dubost

[11] Patent Number: 4,804,423

[45] Date of Patent: Feb. 14, 1989

[54] AL ALLOYS HAVING HIGH PROPORTIONS OF LI AND SI AND A PROCESS FOR PRODUCTION THEREOF

[75] Inventor: Bruno Dubost, St. Egreve, France

[73] Assignee: Cegedur Societe de Transformation de l'Aluminium Pechiney, Paris, France

[21] Appl. No.: 879,347

[22] Filed: Jun. 27, 1986

[30] Foreign Application Priority Data

Jun. 28, 1985 [FR] France ..... 85 10375

[51] Int. Cl.[4] ..... C22C 21/00

[52] U.S. Cl. ..... 148/437; 148/2; 148/11.5 A; 148/11.5 P; 148/438; 148/439; 148/440

[58] Field of Search ..... 420/549, 531, 532, 534, 420/535, 537, 540–546; 148/437, 438, 439, 440, 2, 11.5 A, 11.5 P, 12.7 A

[56] References Cited

U.S. PATENT DOCUMENTS 4,661,172 4/1987 Skinner et al. ..... 148/438

*Primary Examiner*—R. Dean

*Attorney, Agent, or Firm*—Dennison, Meserole, Pollack & Scheiner

[57] ABSTRACT

The invention concerns Al-base alloys with substantial proportions of Li and Si, containing, by weight:

from 3.6 to 8% Li from 5 to 14% Si from 0 to 1% of each of the following optional elements: Fe, Co, Ni, Cr, Mn, Zr, V, Ti, Nb, Mo, $O_2$, Sc, and from 0 to 2% of each of the optional elements Cu, Mg and/or Zn, the total amount of the optional elements being less than 5%, and the balance being Al and impurities, each impurity $\leqq 0.05\%$, with total impurities $\leqq 0.15\%$. The products are obtained by rapid solidification processes and contain from 15 to 60% by volume of phase T (Al, Si, Li), in the form of particles of from 0.01 to 10 $\mu$m.

19 Claims, No Drawings

AL ALLOYS HAVING HIGH PROPORTIONS OF LI AND SI AND A PROCESS FOR PRODUCTION THEREOF

The field of the invention is concerned with Al-base alloys containing substantial proportions of Li and Si and having a medium to high level of mechanical strength, a very low density and a high Young's modulus; a process for the production thereof uses rapid solidification (atomization, hyperquenching on a metal substrate, etc. . . . ), densification and hot shaping.

In accordance with the known prior art, it is known that alloys with an amount of Li of higher than about 3% (by weight) give rise to difficulties in production, which are due in particular to the following aspects:

fragility when semi-continuous casting the alloys in the form of ingots, poor suitability to hot shaping as a result of a low level of ductility, the high degree of intergranular fragility in the state of being quenched and tempered, due to the precipitation of a very large fraction by volume (≧30%) of metastable phase $\delta'Al_3Li$ which is coherent with the matrix and which can be very easily sheared by dislocations, and the high level of sensitivity to spontaneous corrosion at ambient temperature, due to the presence of the equilibrium phase δAl Li at the joints between grains and in the matrix.

In order to solve those problems, metallurgists have proposed adding a few % of hardening elements such as Cu, Mg, Zn and other minor elements controlling recrystallization or the size of the grains of the alloy such as Mn, Cr, Ti, etc. Such alloys also contain very small amounts of Fe and Si (less than 0.1% by weight). However, even if in practice such alloys reach the levels of mechanical strength of conventional aeronautical alloys (2024, 2214, 7075), they suffer from a reduction in density (d) and an increase in the modulus of elasticity (E), which are each limited to about 12%, that is to say an increase in the specific modulus (E/d) of less than 25%.

It has been shown that the joint addition of Li and Si to Al alloys produced by conventional solidification resulted in a poor compromise in regard to mechanical strength, ductility and density (F. W. GAYLE, Aluminium Lithium alloys, Proceeding of the 1st International Al-Li Conference, Ed. By T. H. Sanders, Jr and E. A. Starke, Jr, The Metallurgical Society of AIME, 1981, pages 119 to 139).

The applicants discovered that it is possible to achieve gains in respect of specific modulus of very much greater than 25% in relation to Al-Li-Si alloys containing large amounts of Si and Li, while retaining acceptable mechanical characteristics, a satisfactory level of resistance to spontaneous corrosion, and good suitability for shaping.

That aim is achieved by virtue of the choice of a specific composition, the use of rapid solidification and powder metallurgy techniques, and finally shaping at controlled temperature.

The alloys according to the invention contain (in % by weight):

from 3,6 to 8% of Li from 5 to 14% of Si from 0 to 1% of each of the following elements: Fe, Co, Ni, Cr, Mn, Zr, V, Ti, Nb, Mo, $O_2$, Sc and from 0 to 2% of Cu, Mg and/or Zn, the total amount of said optional secondary elements being less than 5%, balance Al and impurities (each ≦0.05%, total ≦0.15%).

The amount of Li is preferably linked to the amount of Si by the following formulation: % Li=0.4% Si+$k$ with $-1 \leqq k \leqq 5$ and preferably $0 \leqq k \leqq 4$.

The proportion of Li is preferably kept between 4 and 7%.

The total amount of secondary elements (other than Li and Si) is preferably kept below 2%.

However, the properties of the products obtained are satisfactory only if the alloys are produced by rapid solidification at rates of cooling from the liquid state that are higher than 1000° C./second by any known means (solidification on a wheel, atomization, etc. . . . ). That operation is preferably carried out in an inert atmosphere, for example argon or helium. The alloys produced in that way are then consolidated by the known processes used in powder metallurgy, for example, depending on the range: possible crushing operation, cold compacting, degassing possibly under vacuum, compression in the hot condition and working by drawing or extrusion, forging, die stamping or any other method, with a degree of working (initial cross section/final cross section) which is generally higher than 8.

However, when carrying out those various hot shaping operations, the temperature of the product must remain at a value of less than 400° C. and preferably 350° C. in order to give acceptable mechanical characteristics. As indicated, the products are generally used in the crude hot transformation state or after a slight degree of additional deformation at lower temperature, which makes it possible to enhance both flatness, straightness or dimensional tolerances and the mechanical strength characteristics.

In the condition for use, the products when obtained in that way have a large fraction by volume, which is between 15 and 60% and preferably between 20 and 50%, of particles essentially formed by a phase of cubic structure, with a parameter of close to 0.59 to 0.60 nm, identified as a phase T—$Al_2Li_3Si_2$ or Al Li Si, depending on the writers. That phase, being distributed in a homogenous fashion, is of a size between 0.01 and 10 μm, more generally between 0.01 and 5 μm; it is thought that that phase contributes to hardening of the alloy in the cold state and at medium temperatures, the fine and homogenous precipitation thereof being accentuated by a tempering operation between ambient temperature and 350° C., preferably between 150° and 250° C. The microstructure may possibly include a very fine globular precipitation of phase δ ($Al_3Li$), the diameter of which is smaller than 50 nm, and also slight precipitation of free Si or phase δAl Li.

The amount of phase δ' present is less than 10% (by volume). Finally, the products which are obtained in that way are characterised by an extremely fine grain size which is smaller than 20 μm and generally smaller than 10 μm.

If k is lower than the lower limit, that causes the appearance of particles of Si, to the detriment of the phase T, which reduces the mechanical characteristics and specific elastic properties.

If k exceeds the upper limit, that promotes precipitation of the phase δAl Li which experiences spontaneous corrosion and also the phase $\delta'Al_3Li$, which has the effect of making the alloy more fragile.

The applicants also found that, with the same consumption, the hardness of the products increases in proportion to a reducing size of the particles of phase T (Al, Li, Si); in particular very rapid solidification of thin strips (20 to 30 μm in thickness) on a metal substrate ("melt spinning") results at the substrate side in sizes of particles of phase T of from 0.01 to 0.5 μm.

The level of microhardness is then about 40% higher than that obtained on the outside face of the thicker strips or powders obtained by atomization in which the size of particles of phase T is of the order of from 0.5 to 5 μm.

The invention will be better appreciated by reference to the following Examples:

EXAMPLE 1

Alloys whose composition is set forth in Table I were obtained in the form of powder by centrifugal pulverization in a helium atmosphere, the powder being sifted to 200 μm maximum.

The powders were prepared from little cast ingots manufactured from a pure base with an amount of Fe<0.05%.

The following operations were applied:

- put into a container of Al-Mg $\phi 42\times 100$ mm
- degassing for 24 hours at 1 to $10^{-1}$ Pa
- preheating for 1 hour 20 minutes at 250° C.
- direct extrusion at 250° C. in the form of cylindrical bars $\phi 9$ mm (extrusion ratio $\lambda=22$)
- the discharge temperature being approximately 330° C.

The bars obtained were cooled in air and characterised by measurements in respect of density and the Young's modulus and by tensile tests (lengthwise direction) and micrographic examination.

Table I shows the target and obtained by atomic absorption method, chemical compositions and the results obtained (average of 5 tests).

The amount of oxygen is of the order of 0.5%. The phase T present was coarse (mean size 2 μm, maximum size 5 μm) but dispersed homogenously except to a few large particles of phase T (100 to 200 μm), the presence of which explains the low degrees of elongation observed (incipient premature rupture).

In spite of that, the interesting level in respect of the mechanical characteristics obtained is noted, in particular in relation to the alloy Al-6Li-10Si and the substantial plastic range, as well as the substantial variations in density and the Young's modulus.

Micrographic examination in the crude extruded state reveals:

virtually complete absence of phase $\delta' Al_3Li$ and phase δAl Li, and a grain size in the alloy of from 2 to 5 μm.

EXAMPLE 2

Alloys of Al, Li and Si, including the compositions set forth in Example 1, were cast in strips measuring 10 mm×40 μm approximately, in cross-section, on a copper wheel with $\phi$ of 480 mm and rotating at 1000 rpm, from 730° to 830° C.; they were characterised by the value in respect of Vickers microhardness under a load of 10 g, micrographic examination by means of microscopes of optical and electronic type and using X-ray diffraction in the crude cast state and after a tempering heat treatment for from 1 to 10 hours at from 200° to 350° C., to evaluate stability in the hot condition and structural evolution.

The compositions and results obtained are set forth in Table II.

The whole of the strip of composition A and the wheel side of the strips B, C and D, over from 20 to 30 μm, had a fine structure of phase T (size <0.4 μm) in the crude cast state and even after tempering. The external part of the strips B, C and D and the whole of the thickness of the strips E and F had a coarse structure of the order of 1 μm on average (maximum size of 4 μm) in the crude cast state and after tempering.

The fraction by volume of precipitates, evaluated by quantitative image analysis, does not vary significantly in the course of the tempering operations. It is found that hardness increases with the proportions of Li and Si and the fraction by volume of phase T, at least as long as it remains in the form of fine particles.

The fine structures (at the wheel side) give the alloys according to the invention a very high level of hardness after tempering at 200° C. and same remains at a high level even after tempering at 350° C., in contrast to the alloys which are not in accordance with the invention.

EXAMPLE 3

A part of ingots used to obtain powders in alloys of compositions which are identical to those of Example 1 and which were cast in cylindrical chill moulds measuring $\phi$ 55 mm×175 mm with a slow rate of cooling (about 5° C./second) which is typical of conventional casting, were skimmed down to $\phi$ 48 mm and then reheated at 400° C. for 1 hour, then extruded at 400° C. in the form of cylindrical bars of $\phi$ of 9 mm, and cooled in the air.

The mechanical tensile characteristics as measured in the lengthwise direction on 3 testpieces per alloy are set forth in Table III. Prohibitive fragility is found in those products which suffer from premature rupture when put under load, as well as virtually zero ductility.

The microstructure of those products has in particular very coarse particles of phase T (Al, Li, Si), of highly heterogenous and fairly coarse sizes, from several μm to several hundreds of μm, and markedly greater than 10 μm on average, in association with a small amount of phase δAl Li.

This example shows the necessity of using a method involving rapid solidification for the alloys according to the invention.

The products obtained in accordance with the invention have the following advantages:

- a density which is reduced by from 15 to 20% and a Young's modulus which is increased by from 15 to 35% in comparison with those of conventional Al alloys produced by conventional casting as ingots such as 2024, 6061 and 7075 alloys, using the designations applied by the Aluminium Association. The specific modulus is increased by about 30 to 60%;
- a mechanical strength in the cold condition which is comparable to that of medium-strength wrought Al alloys such as 2024-T4, 6061-T6 and 7020-T6, for example for the products containing coarse particles of phase T (0.5 to 10 μm), and equivalent to those of high-strength alloys (7075-T6, 2214-T6, 7010-T736 and 7150-T736 or T6) for products containing a fine phase T (0.01 to 0.5 μm);
- a level of mechanical strength in the warm or in the hot condition, which is higher than that of all the known Al alloys produced by semi-continuous casting (for example the alloys 2214 or 2219, using the Aluminium Association nomenclature), in particular in the range of between 100° and 350° C.;

good resistance to intergranular or localized corrosion in spite of the high proportions of Li, in the absence of phase δAl Li;

sufficient hot or cold ductility to permit shaping or use thereof as mechanical components or structural elements; and attractive mechanical properties which are obtained even in the absence of tempering.

TABLE 1

| Alloy (% by wt.) | Elastic limit 0.2% (MPa) | Tensile strength (MPa) | Elongation (%) | Young's modulus (GPa) | Density ($g/cm^{-3}$) | Specific modulus (GPa $cm^3g^{-1}$) | Δ(E/ρ) (1) |
|---|---|---|---|---|---|---|---|
| Al—5Li—7,5Si (a)<br>4,4Li—7,5Si (b) | 298 | 366 | 0.8–2 | 87.4 | 2.373 | 36.3 | +41% |
| Al—6Li—10Si (a)<br>4,9Li—9,4Si (b) | 330 | 377 | 0.5–1 | 89.2 | 2.341 | 38.1 | +48% |
| Al—7Li—12,5Si (a)<br>5,7Li—11,7Si (b) | 341 | 370 | 0.1–0.3 | 91.3 | 2.291 | 39.8 | +55% |

(1) gain calculated in relation to a conventional high-strength alloy (2024, 7075): $\rho = 2.8$ g/cm$^3$; E = 72 GPa; E/ρ = GPa cm$^3$g$^{-1}$
(a) target composition
(b) obtained composition

TABLE II

| Ref. | | Alloy composition (% by weight) Li | Si | Category | Position | Microhardness values (MPa × $10^{-1}$) as measured on strips: Crude cast state | Tempering 10 hours 200° C. | Tempering 1 hour 350° C. | Tempering 10 hours 350° C. | Fraction by volume of phase T (%) |
|---|---|---|---|---|---|---|---|---|---|---|
| A | (a) | 4.0 | 5.0 | according to the invention (K = 2) | wheel side | 74 ± 4 | 118 ± 5 | 102 ± 6 | — | 15 to 20% |
| | (b) | 3,7 ± 0,15 | 5,1 ± 0,1 | | outward side | 74 ± 4 | 118 ± 5 | 102 ± 6 | — | |
| B | (a) | 5.0 | 7.5 | according to the invention (K = 2) | wheel side | 151 ± 12 | 194 ± 6 | 153 ± 11 | 119 ± 9 | 25 to 35% |
| | (b) | 4,4 ± 0,15 | 7,5 ± 0,2 | | outward side | 112 ± 4 | 145 ± 8 | 91 ± 10 | 87 ± 4 | |
| C | (a) | 6 | 10 | according to the invention (K = 2) | wheel side | 162 ± 9 | 202 ± 5 | 152 ± 8 | 145 ± 4 | 35 to 45% |
| | (b) | 4,9 ± 0,15 | 9,4 ± 0,2 | | outward side | 125 ± 4 | 146 ± 3 | 105 ± 7 | 113 ± 5 | |
| D | (a) | 7 | 12.5 | according to the invention (K = 2) | wheel side | 178 ± 9 | 233 ± 10 | 164 ± 9 | 103 ± 3 | 40 to 50% |
| | (b) | 5,7 ± 0.15 | 1,7 ± 0,3 | | outward side | 134 ± 5 | 138 ± 5 | 123 ± 8 | 91 ± 5 | |
| E | (a) | 8 | 15 | outside the invention | wheel side | 147 ± 10 | 118 ± 6 | — | — | >60% |
| | (b) | — | — | | outward side | 147 ± 10 | 118 ± 6 | — | — | |
| F | (a) | 9 | 17.5 | outside the invention | wheel side | 169 ± 8 | 118 ± 3 | — | — | >60% |
| | (b) | — | — | | outward side | 169 ± 8 | 118 ± 3 | | | |
| G | (a) | 2.9 | 1 | reference outside the invention | wheel side | | | 83 ± 3 | | >10% |
| | (b) | — | — | | outward side | | | 83 ± 3 | | |

(a) target composition
(b) obtained composition

TABLE III

| Alloy (a) (% by weight) | Elastic limit 0.2% (MPa) | Breaking load (MPa) | Elongation (%) |
|---|---|---|---|
| Al—5Li—7.5Si | N.m* | 137 | 0.2–0.3 |
| Al—6Li—10Si | N.m* | 118 | 0.0–0.2 |
| Al—7Li—12.5Si | N.m* | 105 | 0.0–0.2 |

*N.m = not measurable
(a) target composition

What is claimed is:

1. Al-base alloy of limited δ-Al Li precipitation obtained by melting and rapidly solidifying a composition consisting essentially of, by weigtht:

(a) from 3.6 to 8% Li;

(b) 5% < Si < 14%;

(c) from 0 to 1% of each of the optional elements selected from the group consisting of: Fe, Co, Ni, Cr, Mn, Zr, V, Ti, Nb, Mo, $O_2$ and Sc;

(d) from 0 to 2% of each of optional elements selected from the group consisting of Cu, Mg, and Zn;

(e) the total amount of said optional elements being less than 5%; and (f) the balance Al and impurities, each of said impurities ≦0.05%, and the total impurities ≦0.15%.

2. Alloy according to claim 1, wherein %Li=0.4·%Si+$k$, with $-1 \leqq k \leqq 5$.

3. Alloy according to claim 2, wherein $0 \leqq k \leqq 4$.

4. Alloy according to claim 1, 2 or 3, wherein said alloy contains from 4 to 7% of Li.

5. Alloy according to claims 1, 2, or 3, wherein the total amount of said optional elements does not exceed 2%.

6. A worked product comprising an Al-base alloy according to claim 1, containing from 15 to 60% by volume of phase T having an atomic composition $Al_2Li_3Si_2$ or Al Li Si.

7. A product according to claim 6, containing from 20 to 50% by volume of phase T.

8. A product according to claim 6 or 7, containing phase T particles of size between 0.01 and 10 μm.

9. A product according to claim 8, wherein the size of the phase T particles is from 0.01 to 5 μm.

10. A product according to claim 6, wherein the grain size of the alloy is less than 20 μm.

11. A product according to claim 10, wherein the grain size of the alloy is less than 10 μm.

12. A process for producing an alloy according to claim 1, comprising the sequential steps of melting said composition, solidifying from the liquid state a rate higher than 1000° C./second, hot or cold compressing, degassing, and compressing and working in the hot condition.

13. A process according to claim 12, wherein all the hot operations subsequent to solidification take place at a temperature of lower than 400° C.

14. A process according to claim 13, wherein all hot operations subsequent to solidification take place at a temperature lower than 350° C.

15. A process according to claim 12, wherein the hot working operation is completed by slight plastic deformation at lower temperature.

16. A process according to claim 12 or 13, additionally comprising carrying out a tempering operation at between 20° and 350° C., after hot or cold deformation.

17. A process according to claim 16, wherein said tempering operation is carried out at between 150° and 250° C.

18. A process according to claim 12, additionally comprising the step of crushing said solidified alloy before the step of hot or cold compressing.

19. A process according to claim 12, wherein said step of degassing takes place under vacuum.

* * * * *